US007584809B1

(12) United States Patent
Flud

(10) Patent No.: US 7,584,809 B1
(45) Date of Patent: Sep. 8, 2009

(54) MOBILE TRANSPORT RIG WITH FOUR AXELS

(75) Inventor: Sammy Kent Flud, Midland, TX (US)

(73) Assignee: Eagle Rock Manufacruting, LLC, Midland, TX (US)

( * ) Notice: Subject to any disclaimer, the term of this patent is extended or adjusted under 35 U.S.C. 154(b) by 251 days.

(21) Appl. No.: 11/747,155

(22) Filed: May 10, 2007

Related U.S. Application Data

(63) Continuation-in-part of application No. 10/982,365, filed on Nov. 5, 2004, now abandoned.

(51) Int. Cl.
*E21B 19/08* (2006.01)

(52) U.S. Cl. ..... 175/162; 175/85; 175/203; 414/22.54; 414/22.62

(58) Field of Classification Search ..... 175/162, 175/85; 414/22.54, 22.55, 22.56, 22.62, 414/22.67
See application file for complete search history.

(56) References Cited

U.S. PATENT DOCUMENTS 2,721,491 A * 10/1955 Klitzke ..... 173/93
3,063,732 A * 11/1962 Harbers et al. ..... 280/6.16
3,747,402 A 7/1973 Branham et al.
3,917,230 A 11/1975 Barron
3,994,350 A 11/1976 Smith et al.
4,300,276 A 11/1981 Davis
4,407,629 A 10/1983 Willis
4,787,244 A 11/1988 Mikolajczyk
4,796,863 A 1/1989 Reed
4,842,250 A 6/1989 Willis
5,273,388 A * 12/1993 Willis et al. ..... 414/22.54
5,762,279 A 6/1998 Horton, III
6,298,927 B1 * 10/2001 Back ..... 175/52
2004/0069532 A1 4/2004 Keast
2007/0246261 A1 * 10/2007 Lowe et al. ..... 175/26

FOREIGN PATENT DOCUMENTS

WO 9214028 A2 8/1992

* cited by examiner

*Primary Examiner*—Giovanna C Wright
(74) *Attorney, Agent, or Firm*—Buskop Law Group, PC; Wendy Buskop

(57) ABSTRACT

A transport rig having at least one duel axel, with a single point suspension. The transport rig has at least two pneumatic independently and vertically adjustable load supporting axels. A rig floor is mounted above the axels. The rig floor can have a drawworks assembly, a drive engine operatively connected to the drawworks assembly, and a second engine for providing hydraulic power.

9 Claims, 9 Drawing Sheets

MOBILE TRANSPORT RIG WITH FOUR AXELS

CROSS REFERENCE TO RELATED APPLICATION

This patent application claims the benefit, under 35 USC §120, of the prior Non-Provisional application Ser. No. 10/982,365, filed on Nov. 5, 2004. The prior Non-Provisional application Ser. No. 10/982,365 is incorporated herein by reference in its entirety.

FIELD

The present embodiments relate generally to a modular transportable rig for drilling wells, such as oil wells and water wells.

BACKGROUND

There exists a need for a transport rig that folds up for transport and unfolds for use, and includes a derrick, a traveling swivel frame assembly and a duel axel with a single point suspension and four hydraulically adjustable supporting axels.

There exists a need for a transport rig that saves energy by providing a rig that is easier to transport than other transport rigs, using less energy and requiring few oversize load permits.

There exists a need for a transport rig with a top drive and an air braking system that has less weight than a comparable transport rig. A lighter weight transport rig saves numerous gallons of expensive diesel fuel.

There further exists a need for a mobile transport rig that utilizes air power caliper brakes that do not require an external cooling system, while being easily transportable and easy to use Additionally, there exists a need for a transport rig that requires only a two man crew to rig up and operate the rig. Most conventional rigs require at least a four man crew to transport, set up, and operate the rig.

The embodiments described below meet these needs.

BRIEF DESCRIPTION OF THE DRAWINGS

The detailed description will be better understood in conjunction with the accompanying drawings as follows.

Figure 1:
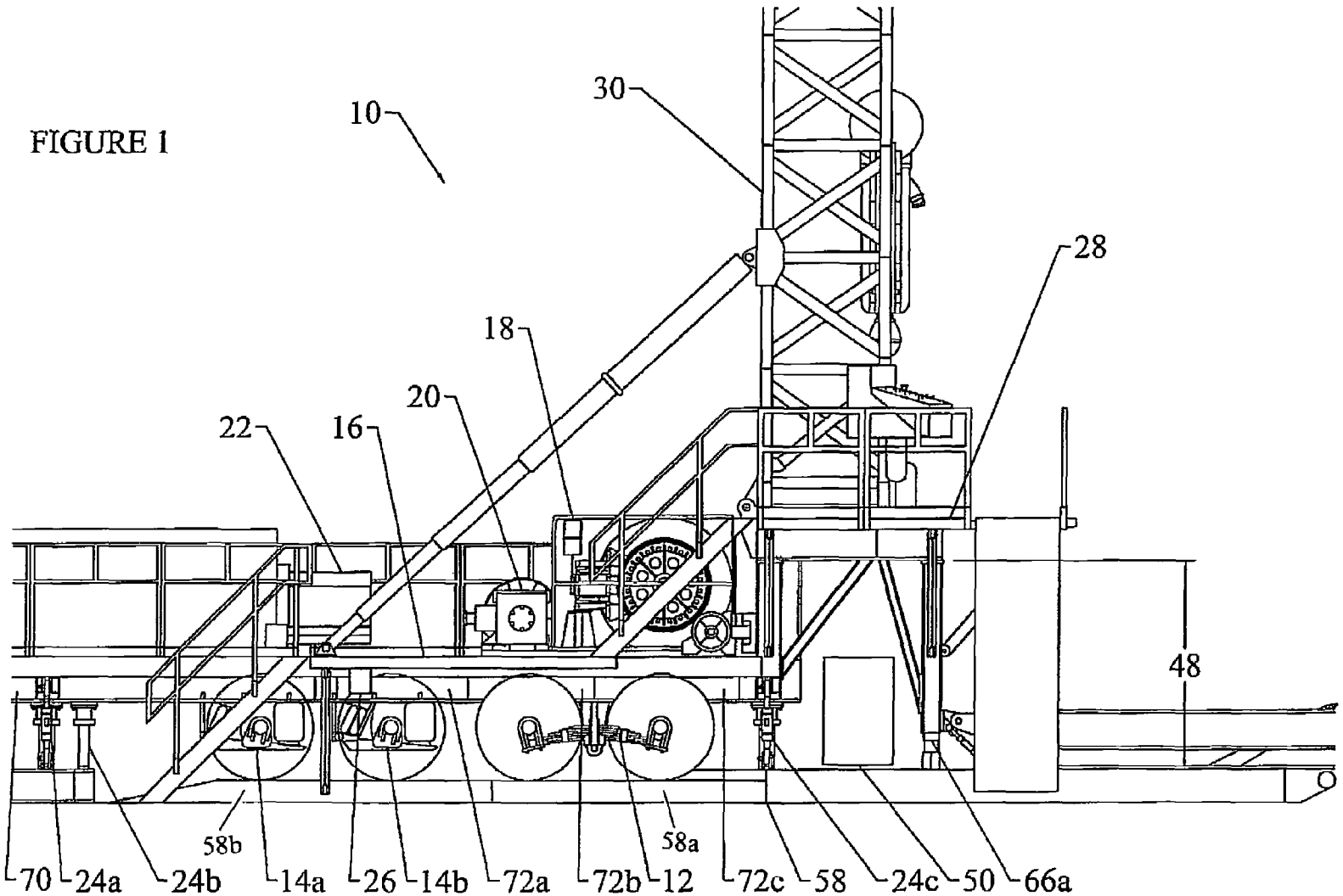
FIG. 1 depicts a side view of an embodiment of the transport rig.

The present embodiments are detailed below with reference to the listed Figures.

DETAILED DESCRIPTION OF THE EMBODIMENTS

Before explaining the present embodiments in detail, it is to be understood that the embodiments are not limited to the particular embodiments and that they can be practiced or carried out in various ways.

The embodied invention is for a compact transport rig that folds up for transport and unfolds for use, and includes a derrick, a top drive, and air brakes. The compact transport rig saves energy by providing a movable frame assembly that prevents excessive wear on the derrick as compared to other known traveling frame assemblies. The traveling swivel frame assembly prevents wear to the derrick because the traveling swivel frame assembly has wheels, which allow better control of the top drive movement on the derrick.

An embodiment of the traveling swivel frame assembly has large diameter wheels for transporting the traveling swivel frame assembly. The large diameter wheels enable more load to be distributed over a larger area. The large diameter wheels absorb side load shock from the top drive. The traveling swivel frame assembly weighs less than other known traveling frame assemblies. The large diameter wheels provide a safe rig, less likely to fail due to vibrations caused during drilling operations.

The traveling swivel frame assembly saves energy by combining a hoisting device and a drilling mechanism support device into one unit.

The traveling swivel frame assembly can absorb large amounts of energy. The traveling swivel frame assembly can handle large forces and stresses without failing. Stress is distributed equally among both sides of the traveling swivel frame assembly.

The entire load is kept aligned with the traveling swivel frame assembly, which prevents offset stress, and stops the creation of bending moments in the traveling swivel frame assembly. The traveling swivel frame assembly of the present embodiments exerts a straight pulling force. The straight pulling force reduces the possibility of damage, increases safety, and lowers the cost of operating during a drilling operation, such as drilling water wells and drilling oil wells.

The embodied travel swivel frame assembly with top drive and hydraulic wrench has a light weight design compared to conventional top drive designs.

In an embodiment, the compact transport rig with top drive and hydraulic wrench weighs up to 50% less than the weight of a comparable drilling machine using a rotary table. The lightweight embodiments of the compact transport rig only needs one truck to move the compact transport rig from one location to another, thereby saving numerous gallons of expensive diesel fuel. In an embodiment, this rig uses about 450 gallons of diesel per day, which is considerably less than comparable conventional drilling machines with rotary tables and other drilling components .

The embodied transport rig saves energy by utilizing a unique braking system that utilizes less fossil fuel and/or electricity than conventional drilling systems. The air power caliper brakes do not require an external cooling system, thereby saving large amounts of energy that are typically required on land based rigs.

The embodiments of the invention generally reduce the costs associated with setting up drilling equipment, and reduces the risk of injury to workers at the drilling site by eliminating the need to lift heavy parts with a crane.

The embodiments of the invention save the environment by minimizing the impact of drilling operations on the surrounding environment. This is important as the need to drill for oil in remote undisturbed environments increase.

In an embodiment of the invention the transport rig can have at least one duel axel, with a single point suspension. The transport rig can further have at least two pneumatic independently and vertically adjustable load supporting axels. The transport rig also can have a rig floor mounted elevated to the axels.

In an embodiment of the transport rig there can be at least two additional leveling jacks which are mechanically operable.

The rig floor can include a drawworks assembly, a drive engine operatively connected to the drawworks assembly, and a second engine for providing hydraulic power.

In an embodiment of the transport rig there can be at least one air caliper brake secured to the rig floor for additionally controlling movement of the top drive along the rails of the derrick. The air caliper brakes can be air cooled.

In the present embodiment of the invention there are at least four hydraulic leveling jacks, with control levers connected to the rig floor, for raising and lowering the rig floor.

In the present embodiment of the invention the transport rig has an elevated drilling floor integrally connected to the rig floor. The elevated drilling floor supports a derrick. In the present embodiment the derrick can have at least two rails for supporting a traveling top drive. The traveling top drive can be supported by a crown block connected to the derrick.

The transport rig also has a control panel comprising a power throttle for operating the top drive. In an embodiment of the transport rig the control panel can have an emergency an emergency all stop for stopping the top drive, the hydraulic wrench, and hydraulic pipe handler. The control panel can also have control panel further a forward and reverse throttle for the top drive. The all stop control can be a button, switch, or a fuse.

There can be a slip bowl for supporting drilling tubulars disposed on the drilling floor, and a hydraulic wrench for making up a breaking out the drilling tubulars generally in line with the slip bowl.

The elevated drilling floor can have a height sufficient to permit the installation of well control equipment between the drilling floor and the ground.

The transport rig can have a pipe-handler. The pipe handler can have at least two pipe grippers. The pipe-handler can be used for transporting the drilling tubulars from a horizontal storage position to the derrick for engagement with the traveling top drive.

In the present embodiment the transport rig can be disposed on a moveable mat, which supports the rig floor during drilling. The moveable mat can be a two piece mat.

It is contemplated that the transport rig can have an auxiliary control panel allowing two people to simultaneously control the hydraulic system.

In an embodiment of the transport rig, a subdeck can be disposed beneath the rig floor comprising an array of trays to accommodate hydraulic line and to catch rig fluid.

The present embodiments save lives by requiring only a two man crew to rig up and operate the transport rig. Most conventional drilling rigs require at least a four man crew to transport, set up, and operate the rig. The present embodiments require only a driller and a helper. Conventional rigs typically require a driller, a helper, a tong operator, and a derrick man for racking pipe. Finger tip controls, which are in part hydraulically operated pipe handler and hydraulic wrench, enable drilling operations using only two operators.

Figure 2:
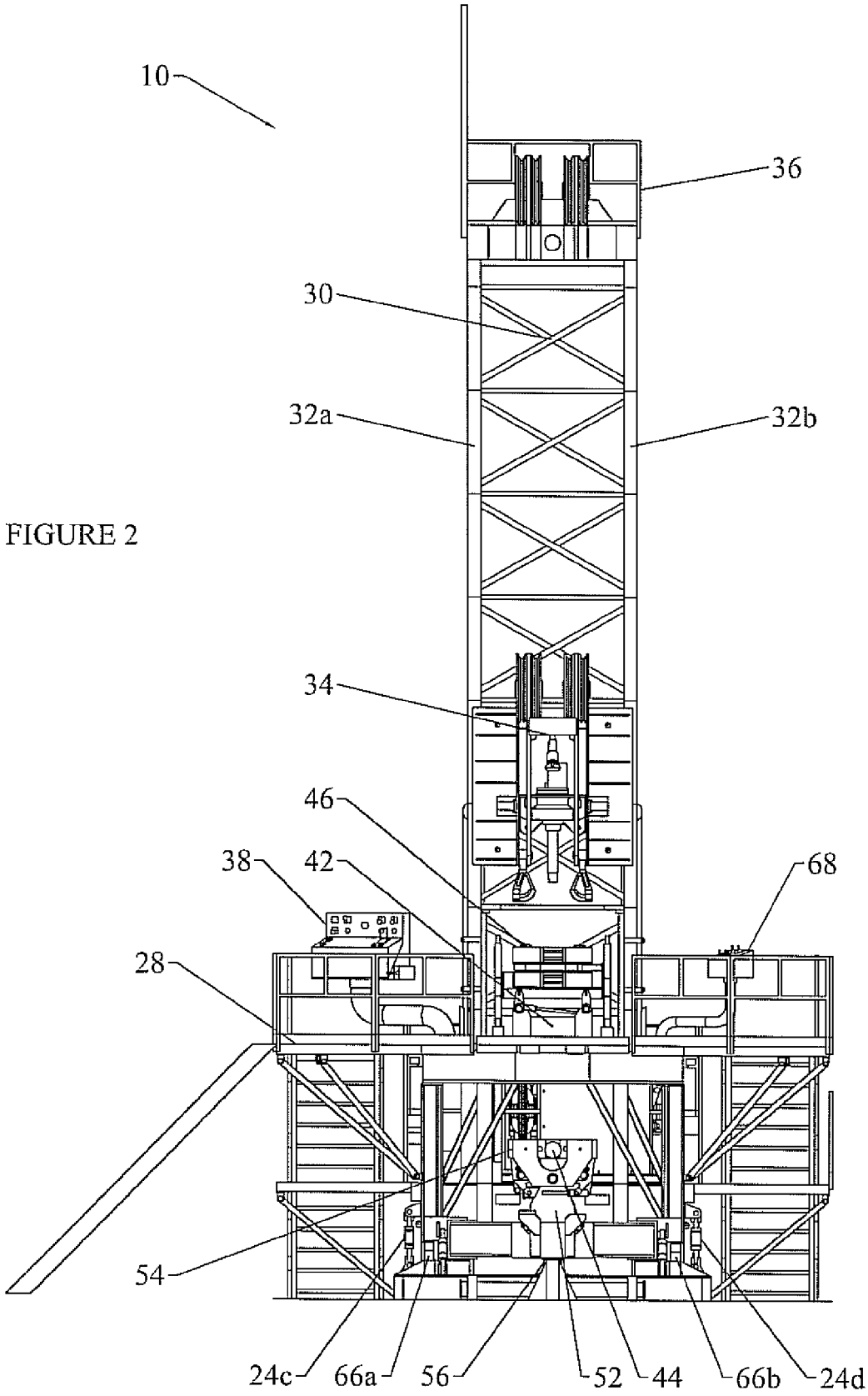
FIG. 2 depicts a front view of traveling swivel frame assembly usable on the transport rig.

With reference to FIG. 1 and FIG. 2, which depict an embodiment of the transport rig 10. The transport rig 10 as depicted has at least one duel axel, with a single point suspension 12. The transport rig 10 is also depicted having at least two pneumatic independently and vertically adjustable load supporting axels 14*a* and 14*b*. The pneumatic vertically adjustable axels 14*a* and 14*b* can have a force capacity from 0 to 3000 pounds.

A rig floor 16 is mounted over the one duel axel with single point suspension 12. The rig floor 16 can have an overall length of up to 60 feet and can be up to 9 feet wide, but 8 foot wide and 52 feet long is a typical embodiment. The rig floor 16 is made out of steel.

The rig floor 16 includes a drilling drawworks assembly 18, which can be an Eagle Rock 500, manufactured by Eagle Rock Drilling of Midland Texas. The drawworks assembly 18 can be powered by a drive engine 20, such as a Cat C-15 engine, manufactured by Caterpillar™.

The rig floor 16 is further depicted having a second engine 22, such as a Cat C-15 engine, for providing hydraulic power. The drive engine 20, which can be a one or two Caterpillar™ engines, or an internal combustion engine, is disposed on the rig floor 16. The drive motor 20 is attached to the rig floor 16 by welding, threaded fasteners, or other similar means.

The rig floor 16 can be secured to four hydraulic leveling jacks 24*a*, 24*b*, 24*c*, and 24*d*. The leveling jack 24*a* and 24*c* are depicted disposed on one side of the rig floor 16, and hydraulic jacks 24*c* and 24*d* are disposed on the opposite side of the rig floor 16. The four hydraulic leveling jacks are used for raising and lowering the rig floor 16. The four hydraulic leveling jacks can support a force of at least 3,000 pounds. The four hydraulic leveling jacks can be operated by control levers 26 disposed on the rig floor 16 and in fluid communication with each of the hydraulic leveling jacks.

The rig floor 16 has a subdeck 70, which is made from a plurality of trays 72*a*, 72*b*, and 72*c*. The subdeck 70 contains hydraulic lines and prevents hydraulic fluid from leaking onto the ground. This ensures that the environment is not harmed from leaking fluid.

An elevated drilling floor 28 is secured to the rig floor 16 and at an elevated position relative to the rig floor 16. The elevated drilling floor 28 has a slip bowl 42. The slip bowl 42 can have a diameter for accommodating 4½ inch, 16.6#/ft,X-95 NC-46(X-Hole) connections possible drill collars usable through the slip bowl 42 can have a 6½ inch to 8 inch OD and a 2¼ to 6⅝ inch ID w/31 inch long w/NC-46 (X-Hole) connections. A hydraulic wrench 46 is centrally secured at the base of the derrick 30 and aligned with the slip bowl 42.

A first additional leveling jack 66*a* and a second additional leveling jack 66*b* are depicted disposed on the elevated deck. In the present embodiment the first additional leveling jack 66*a* and second additional leveling jack 66*b* are mechanically operated. It is contemplated that the first and second additional leveling jacks 66*a* and 66*b* can be hydraulically operated. In another contemplated embodiment it is possible to have more than 2 additional leveling jacks. The leveling jacks can be secured to rig floor or the elevated drilling floor.

The elevated drilling floor 28 can have a height 48, such as 20 feet. The height 48 can be such that drilling equipment can be stored between the moveable mat 58 and the elevated drilling floor 28. In FIG. 1, the moveable mat 58 is shown as being a two piece mat, which can comprise two piece mat sides 58*a* and 58*b*. The drilling equipments can include spare parts, additional drill string, replacement drill bits, or similar equipments used in drilling operations.

The hydraulic wrench 46 can be secured by welding, threaded fasteners, or substantially similar methods. The hydraulic wrench 46 can have two housings with each housing containing a pair of clamp teeth, which can be best seen in FIG. 2. The clamp teeth are aligned for receiving a tubular and making up or breaking out tubulars. The tubulars are supported by the slip bowl while being acted on by the hydraulic wrench 46.

A derrick 30 has a base 31 mounted to the elevated drilling floor 28 surrounding the slip bowl 42. The derrick 30 can be made out of steel and can be a derrick such s a CND Machine 66 foot 6 inch CND Machine with a 3,000 pound static hook load and certified pull test to 300,000 pounds. The derrick has at first rail 32*a* and a second rail 32*b*. The rails 32*a* and 32*b* guide a traveling top drive 34. The traveling top 34 is supported by a crown block 36.

A control panel 38, such as a panel having a plurality of controls for the hydraulic line, top drive, drawworks assembly having a drive motor, pumps, generator, and braking system. The control panel is depicted in further detail in Figure. The elevated drilling floor 28 can have an auxiliary control panel 68 similar to the control panel 38 for allowing two people to simultaneously operate the hydraulic system.

A hydraulic pipe handler 52 is secured to a transport rig 10. The hydraulic pipe handler 52 is secured to the front of the transport rig 10 and the moveable mat 58 so that the hydraulic pipe handler 52 can rotate from a horizontal storage position to a vertical position engaging a tubular with the traveling top drive 34.

The securing mechanism can be a pin. The hydraulic pipe handler 52 is made from steel, has a length from 30 feet to 70 feet. The hydraulic pipe handler 52 can be hydraulically operated to raise tubulars into a position for drilling. The hydraulic pipe handler 52 can lift approximately 1,000 tubulars into a drilling position per day. The hydraulic pipe handler has two pipe grippers 54 for securing the drilling tubular 44 during positioning operations.

A hydraulic cylinder is secured to the moveable mat 58 and the hydraulic pipe handler 52, by the use of a bracket. When the hydraulic cylinder 580 is extended the hydraulic pipe handler will be moved to its second position, which is the vertical position. When the hydraulic cylinder is retracted the hydraulic pipe handler 52 will return to its first position, which is a horizontal storage position 56 for a drilling tubular 44. FIG. 2 depicts a front view of an embodiment of the transport rig 10 deployed in a storage position 56. The transport rig 10 can additionally have at least one generator secured to the rig floor 16; the generator can be a 155 KW generator having a 300 horse power electronic low emission diesel.

A blow out preventor can be used with the derrick 30. The transport rig 10 can have two pumps, such as two National C-350 w/5½ inch liners powered by Caterpillar™ engines. The two pumps can be disposed on the rig floor 16. The transport rig 10 can also have a mud mixing pump, such as a 3 by 4 by 13 centrifugal powered by a 25 horse power electric motor.

Figure 3:
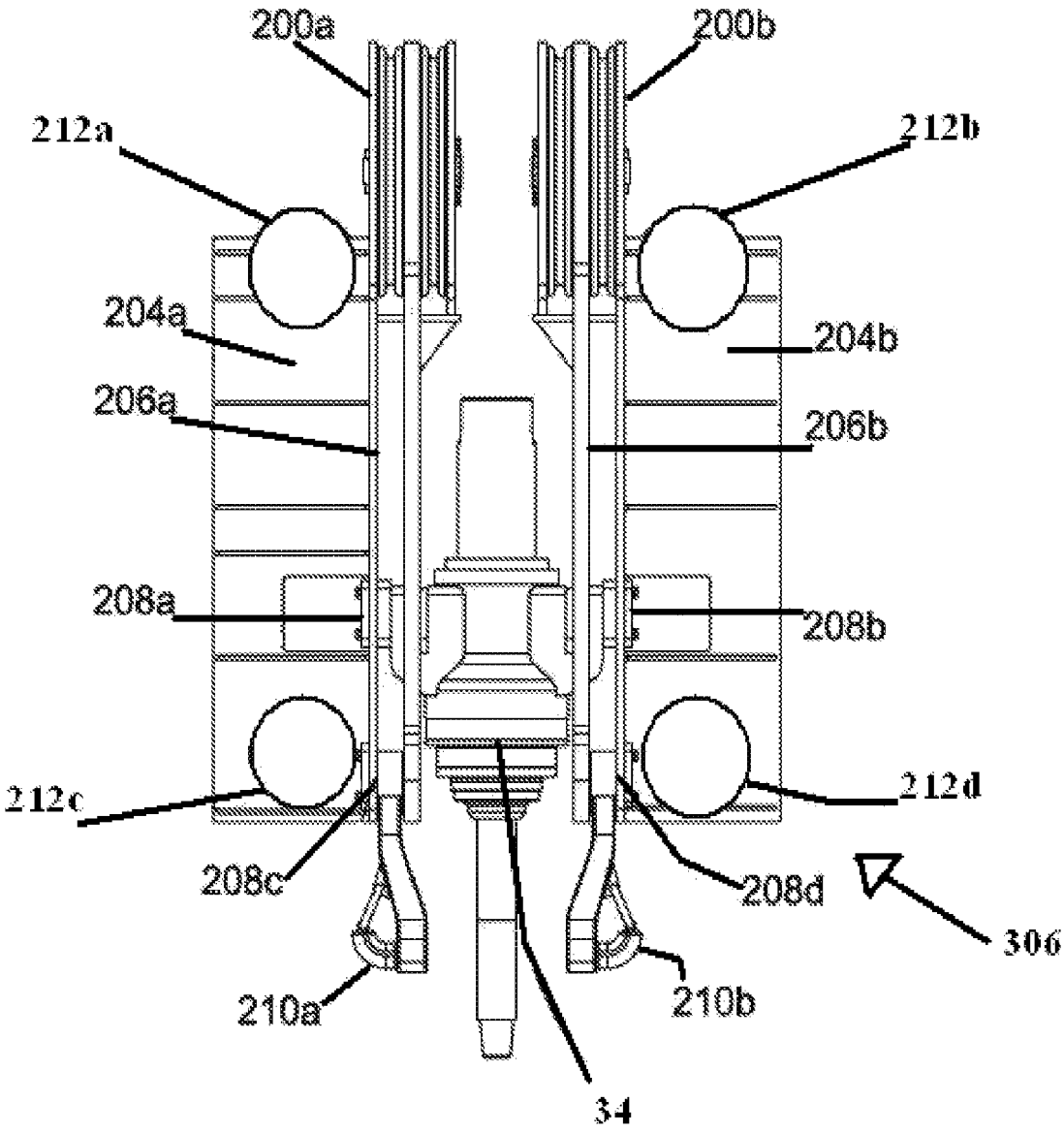
FIG. 3 depicts a back view of a traveling swivel frame assembly usable on the transport rig.

FIG. 3 depicts the back side of traveling top drive 34 disposed in a traveling swivel frame assembly 306 and includes four wheels 212*a*, 212*b*, 212*c*, 212*d*. The four wheels can have a diameter larger than 10 inches and can be made out of rubber such as segmented rubber, non-segmented rubber, a rubber composite, a synthetic rubber, and combinations of these.

The four wheels 212*a*, 212*b*, 212*c*, and 212*d* are attached to a first and second guide frame 204*a* and 204*b* of the traveling swivel frame assembly 306. The traveling swivel frame assembly 306 has adjustable brackets which are used to attaché the four wheels 212*a*, 212*b*, 212*c*, and 212*d*. The first and the second guide frames 204*a*, 204*b* are located on the opposite sides of the top drive.

The rubber wheels 212*a*, 212*b*, 212*c*, 212*d* are adapted to dissipate the torque created by the traveling top drive 34. The rubber wheels 212*a*, 212*b*, 212*c*, 212*d* align the top drive with the support guides, not depicted in FIG. 3. The top drive is aligned with the guide frames 204*a*, 204*b* such that the top drive 220 is substantially parallel to the guide frames 204*a* and 204*b*.

The traveling swivel frame assembly 306 has two pairs of traveling sheaves 200*a* and 200*b*. The traveling sheaves 200*a* and 200*b* can be made of steel. The wheels 212*a*, 212*b*, 212*c*, 212*d* include mounting points. The wheels reduce the vibration on the entire drilling unit preventing additional wear on the parts of the system.

The top drive unit 34 is attached to the traveling swivel frame assembly 306 at the first and the second load structures 206*a* and 206*b*. Pins 208*a* and 208*b* are used to attach the top drive unit 220, such as a Venturetech XK-150 power swivel rated for 150 tons and independently powered by a C-9 Cat engine mounted on the rig floor 10, an alternative top drive unit 220 can be a King 15-PS Power swivel (130 ton) independently powered by a C-9 Cat engine mounted the rig floor 10, to the first and the second load structures 206*a* and 206*b*, A first cobra hook 210*a* is attached to the first guide frame 204*a* using fastener 208*c* and the second cobra hook 210*b* is attached to the second guide frame 204*b* using fastener 208*d*. The fasteners can be pins, such as 2½ inch to 3 inch diameter pins.

In an embodiment, one pin is used on each side of the traveling top drive 34 to affix it to the load structure. Elevator links are attached to the hooks 210*a* and 210*b*. The elevator links are used to lift drill pipe, drill casing, drilling collars, and other drilling items from a horizontal position as they are stored into a vertical position for drilling.

Figure 4:
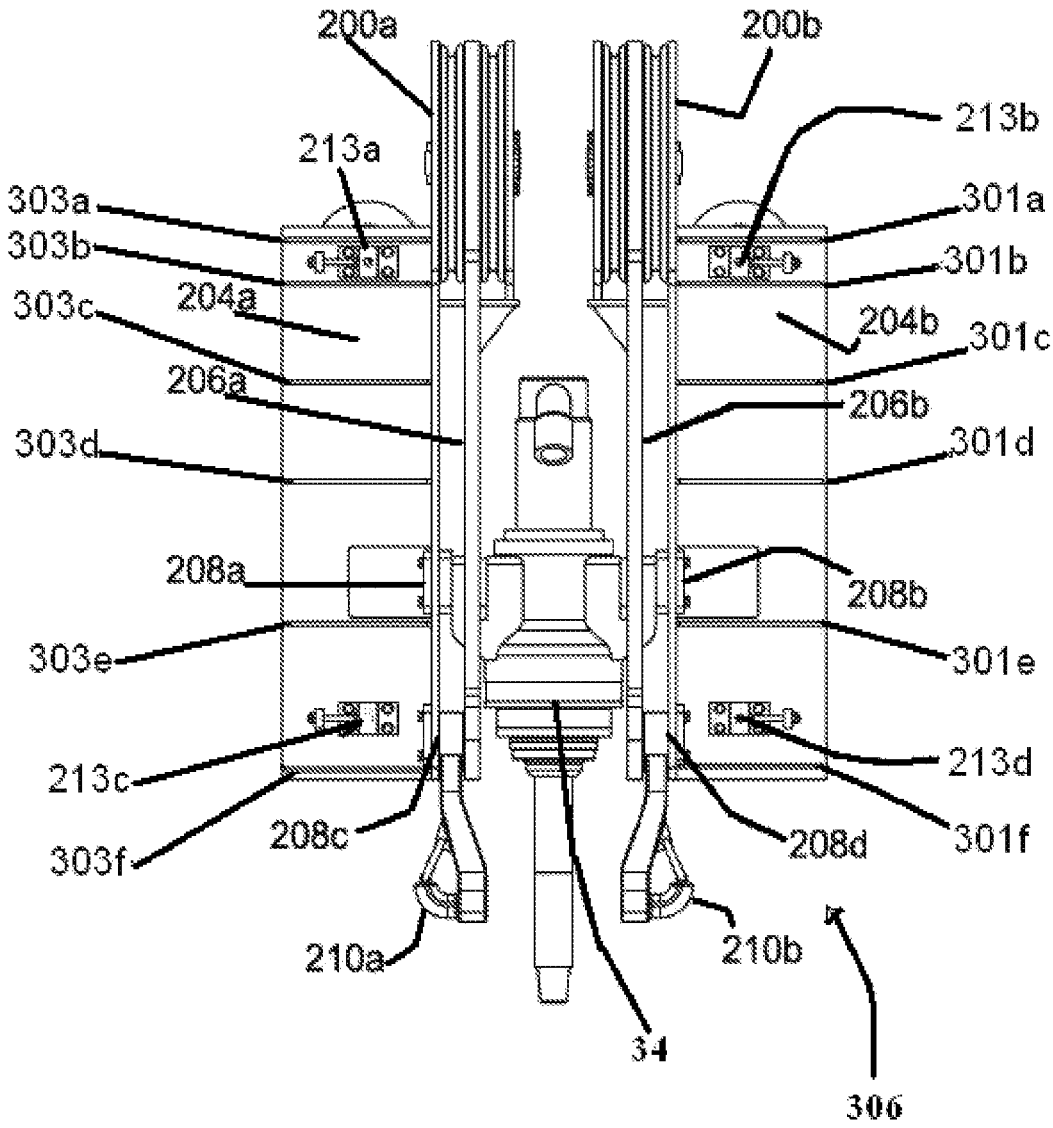
FIG. 4 depicts a front view of the traveling swivel frame assembly usable on the transport rig.

FIG. 4 shows a front view of an embodiment of the traveling frame assembly 306. The traveling frame assembly 306 has guide frames 204*a* and 204*b* the first guide frame 204*a* has stiffeners 303*a*, 303*b*, 303*c*, 303*d*, 303*e*, 303*f*, such as steel bars, or rebar. The second guide frame 204*b* has stiffeners 301*a*, 301*b*, 301*c*, 301*d*, 301*e*, 301*f*, which are substantially similar to the stiffeners on the first guide frame 204*a*. The stiffeners 301*a*, 301*b*, 301*c*, 301*d*, 301*e*, 301*f*, 303*a*, 303*b*, 303*c*, 303*d*, 303*e*, 303*f* are adapted to strengthen the guide frame and resist torque created by the top drive. The wheels 212*a*, 212*b*, 212*c*, and 212*d* are mounted to the guide frames 204*a* and 204*b*. The wheels 212*a*, 212*b*, 212*c*, 212*d* include adjustable brackets 213*a*, 213*b*, 213*c*, 213*d* attached to the guide frame. The adjustable brackets can be made of steel and can have a thickness of from 1 inch to 4 inches. The sheaves 200*a* and 200*b* are also depicted in FIG. 4.

Figure 5:
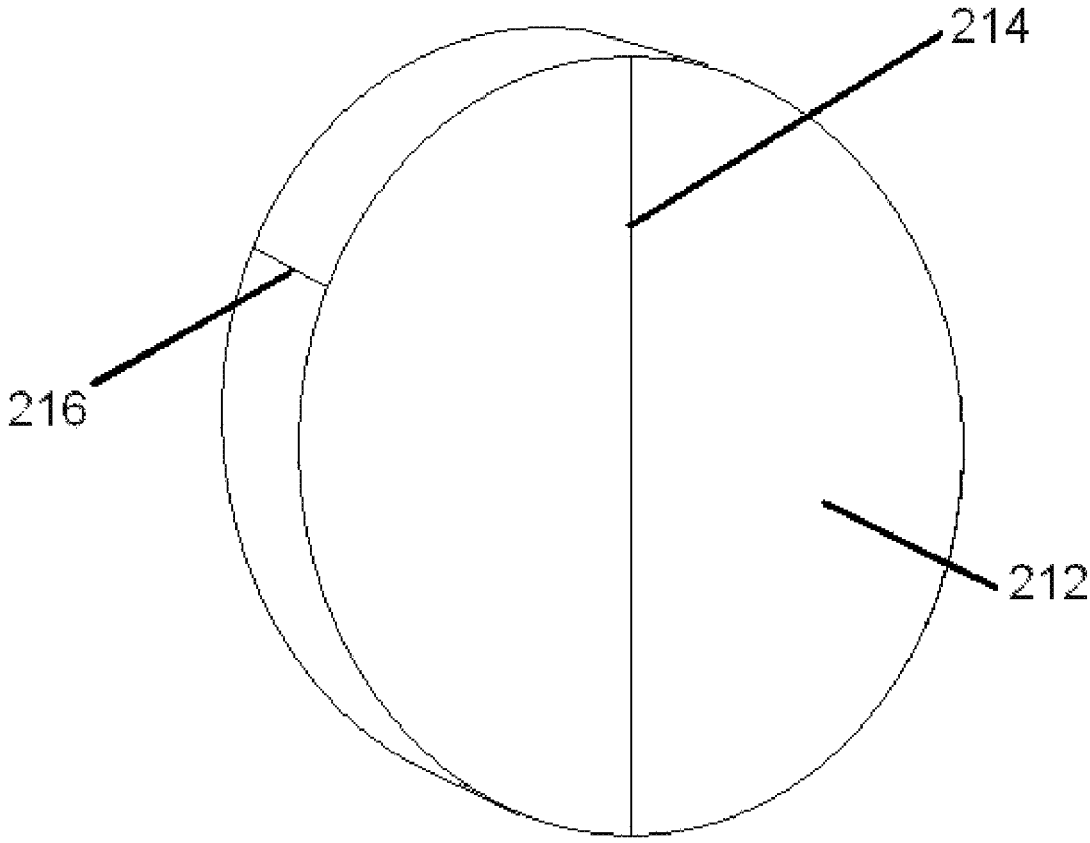
FIG. 5 depicts a perspective view of a wheel usable with the traveling swivel frame assembly usable on the transport rig.

FIG. 5, depicts a perspective view of the wheels usable in the embodiments of the traveling frame assembly 306. The wheel 212 has a diameter 214 and a width 216. The diameter of the wheels can be larger than 10 inches. The wheels can be attached to the first load structure and the second load structure.

Figure 6:
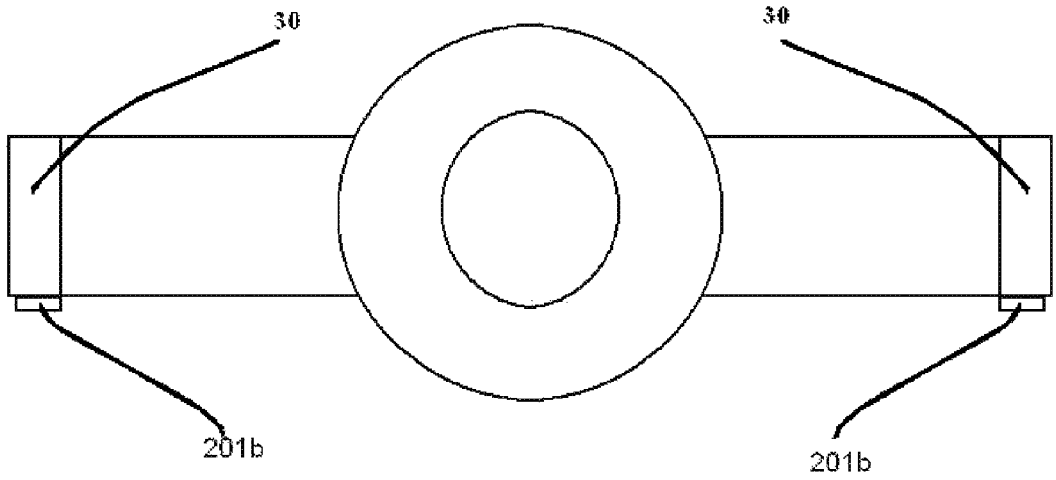
FIG. 6 depicts a top view of the guide frame retainer plate usable on the traveling swivel frame assembly usable on the transport rig.

FIG. 6, depicts a first guide retainer plate 201*a* and a second guide retainer plate 201*b* usable on the traveling swivel frame assembly 306. The guide retainer plates, which have a thickness of from 1 inch to 10 inches and are made of steel, are located over the support guide and are removable from the support guide; the support guide is not depicted in FIG. 6. The retainer plates are adapted for the removal of the top drive unit 34 from the two derrick rails 32*a* and 32*b*

The guide retainer plate can be used to quickly remove the traveling swivel frame assembly 306. The traveling swivel frame assembly is removed by first removing the guide retainer plate along the driller's side and, then, rotating the guide to clear the leg of the derrick. Once the guide is clear of the derrick the top drive unit can be laterally displaced. The method ends by removing the swivel pins, which have a length between ¼ of an inch to about 5 inches, a diameter of between ¼ of an inch to approximately 2 inches, and are made of steel, of the top drive to separate the components for maintenance.

Figure 7:
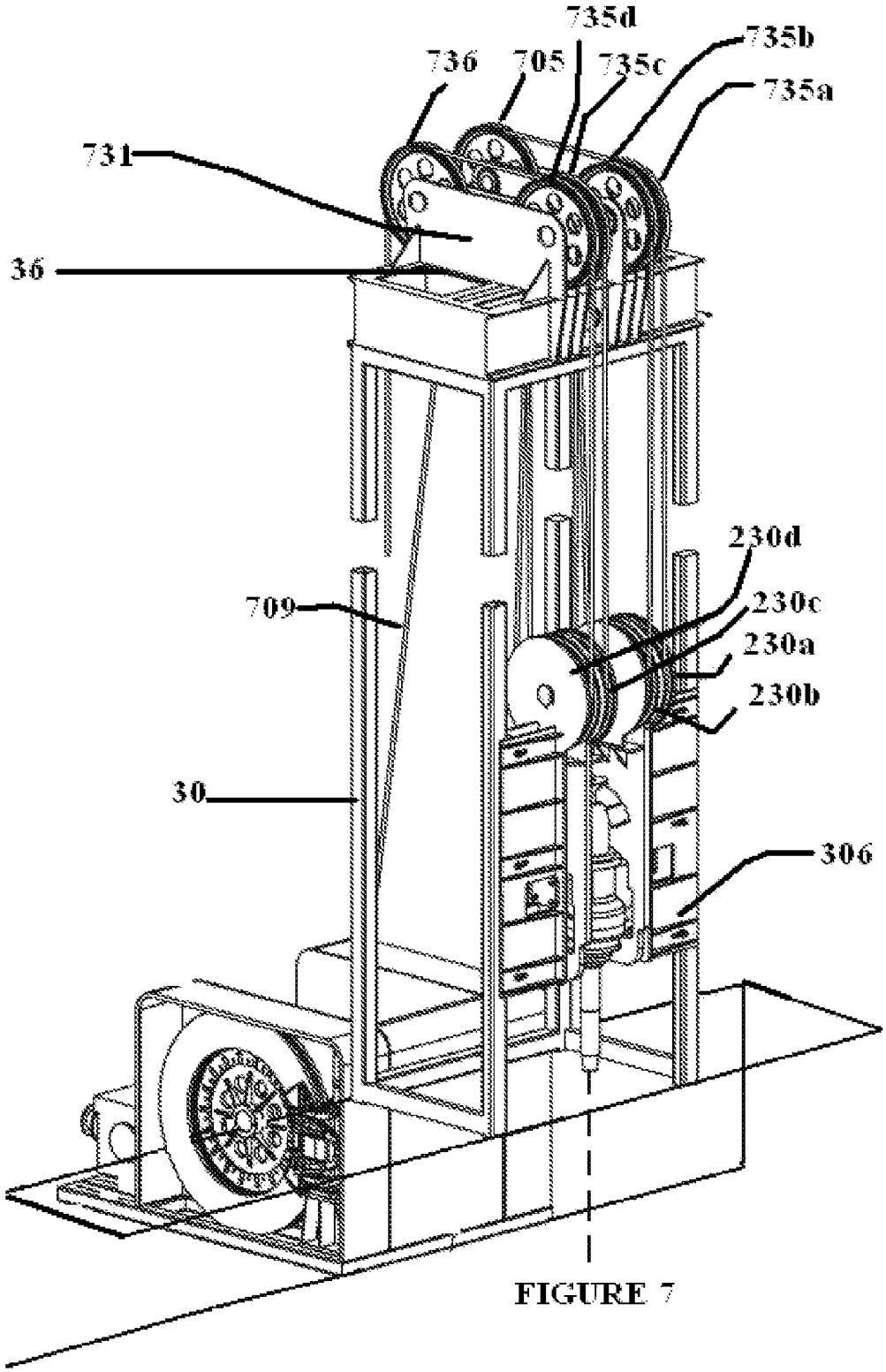
FIG. 7 depicts a view of the traveling swivel frame assembly operatively attached to a derrick usable on the transport rig.

FIG. 7 shows, a crown block 36 mounted on the derrick 30 for receiving and conveying a drilling line 709. The drilling line 709 can be a wire rope or steel cable with a diameter ranging from 1-inch to 1⅛ inches. An example of a drilling line is Flex-X-9™ available from Wire Rope Corporation of America of Missouri.

The sheaves are wheels or pulleys that carry cable, wire rope, or other type of flexible drilling line. The drilling line 709 travels along any portion of the circumference of the sheave without coming off of the sheave. An example of a sheave is McKissick sheave available from Crosby Group of Tulsa, Okla. The sheaves are used to change the direction of the drilling line and can each rotate around an axis.

Continuing with FIG. 7, the crown block 36 has four front sheaves 735*a*, 735*b*, 735*c*, and 735*d*. The crown block 36 has a frame 731 for attaching a fast line sheave, a dead line sheave, and the front sheaves to the crown block 36. In other embodiments, fewer or more than four front sheaves can be used depending on the hoisting capacity of the top drive. Alternatively, the four front sheaves can each be two pairs of sheaves.

A fast line sheave 705 mounted to the crown block assembly 36 for receiving the drilling line 709. The first front sheave 735*a* transfers the drilling line 709 from the fast line sheave 705 to the first traveling sheave 200*a*. The first traveling sheave 200*a* transfers the drilling line 709 to the second front sheave 735*b*. The second front sheave 735*b* transfers the drilling line 709 to the second traveling sheave 200*b*. The second traveling sheave 200*b* transfers the drilling line 709 to the cross over sheave 731.

A cross over sheave 731 transfers the drilling line 709 to the third traveling sheave 200*c* and the third traveling sheave transfers the drilling line 709 to the third front sheave 735*c*. The third front sheave 735*c* transfers the drilling line 709 to the fourth traveling sheave 200*d* and the fourth traveling sheave 200*d* transfers the drilling line 709 to the fourth front sheave 735*d*. The fourth front sheave 735*d* transfers the drilling line 709 to the dead line sheave 736.

Figure 8:
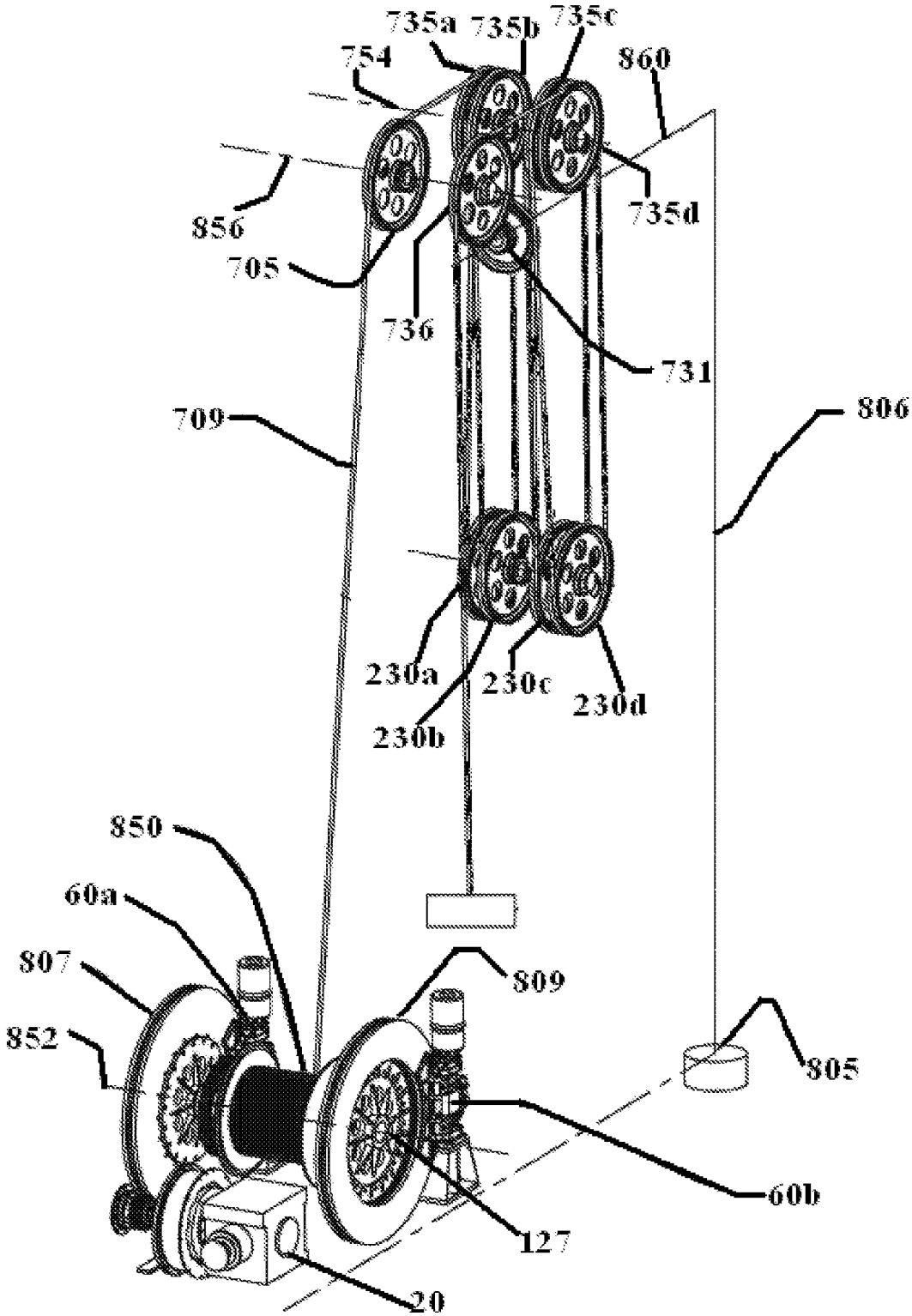
FIG. 8 depicts a perspective view of the path of a drilling line usable with the traveling swivel frame assembly on a transport rig.

FIG. 8 depicts an embodiment of the drawworks assembly 18 having a drive shaft 127 is shown secured to the drawworks drum 850. The drawworks assembly 18 is securely fixed to the rig floor 10. The drawworks assembly 18 can be secured by using threaded fasteners, welds, or other similar means.

The drawworks has a drive shaft 127, which is made from steel in the center of a drawworks drum 850, which is made of steel. The drawworks drum 850 is driven by the drive engine 20. The drawworks assembly has a drawworks drum 850 with brake and disc assembly having a capacity of 500 Horsepower (hp). The brakes can be air caliper brakes. The drawworks assembly 18 has an air clutch and a controller to operate the drawworks 18. The drawworks drum 850 has a width with a midpoint equal to one half of the width of the drum 850. The midpoint of the drawworks drum assembly 807 is aligned with the midpoint of the fast line sheave, so that a maximum angle of less than 15 degrees is created by the drilling line and the fast line sheave are the same when the drilling line is at the edge of the drawworks drum 850.

The first traveling sheave 200*a* of the traveling swivel frame assembly 306 receives the drilling line 709 from the first front sheave 735*a*. A second front sheave 735*b* is mounted to the crown block assembly for transferring the drilling line 709 from the first traveling sheave 200*a* to the second traveling sheave 200*b*.

For safety reasons, the cross over sheave preferably has a diameter of twenty times the drilling line diameter to accommodate many sizes of the traveling swivel frame assembly and to minimize drilling line stress. The diameter of all of the sheaves is at least twenty times larger than the diameter of the drilling line. In an embodiment, the deadline sheave, the first front line sheave, the second front line sheave, the third front line sheave, and the fourth front line sheave each have a diameter thirty times larger than the diameter of the drilling line.

Returning to FIG. 7, a first front sheave 735*a* transfers the drilling line 709 from the fast line sheave 705 to the first traveling sheave 200*a*. The first traveling sheave 200*a* transfers the drilling line 709 to the second front sheave 735*b*. The second front sheave 735*b* transfers the drilling line 709 to the second traveling sheave 200*b*. The second traveling sheave 200*b* transfers the drilling line 709 to the cross over sheave 731. The cross over sheave 731 receives the drilling line 709 from the second traveling sheave 200*b*. The third traveling frame sheave 730*c* receives the drilling line 709 from the crown cross over sheave 731.

A third front sheave 735*c* receives the drilling line 709 from the third traveling frame sheave 200*c* and a fourth traveling frame sheave 200*d* receives the drilling line 709 from the third front sheave 735*c*. The fourth front sheave 735*d* receives the drilling line from the fourth traveling frame sheave 200*d* and the deadline sheave 736 receives the drilling line 709 from the fourth front sheave 735*d* and transfers the line to a deadline anchor 740.

FIG. 8 shows the drawworks drum 850 with a drum axis 852. The width of the drawworks drum 850 is such that the drilling line 709 and the fast line sheave do not create an angle of 15 degrees or more regardless of where the drilling line 709 is on the drawworks drum 850. The front sheaves 735*a*, 735*b*, 735*c*, and 735*d* are all aligned on a front axis 854. The fast line sheave and the deadline sheave are both aligned on a back axis 856. The traveling frame sheaves 200*a*, 200*b*, 200*c*, and 200*d* are each mounted on the traveling top drive 34 using the traveling frame. The front axis, back axis, and traveling frame axis are parallel to the drum axis. The cross over sheave defines a cross over axis 860 and the cross over axis creates an angle with the drum axis 852 that is perpendicular or about 90 degrees.

In an embodiment, the cross over axis 860 is parallel to the ground and is perpendicular to a well bore vertical axis 806 extending from the well bore 805.

The drawworks assembly can include two air operated caliper brakes 60*a* and 60*b* for slowing or stopping the rotation on the drawworks drum. The air operated caliper brakes are mounted to the drawworks assembly with an air cooled disc installed on the drawworks drum. The disks for the air operated caliper brakes are preferably a size of about 60 inches in diameter. This size allows the brakes to cool themselves adequately with the surrounding air and does not require a secondary cooling system. An example of the air operated caliper brake or those sold by Kobelt, of Vancouver, Canada.

In an embodiment, the air caliper brakes have air cooled discs 807 and 809. Air cooled air caliper brakes are more cost effective to be used on a transport rig than water cooled brakes that require associated piping to carry water to and from the brakes. The air operated caliper brake system eliminates the need of a water cooled auxiliary braking system for lowering of the traveling assembly. A specifically sized main drum along with the placement of the drawworks eliminates any side load on the fast line sheave, thereby reducing the wear and stresses on the drilling line and the sheaves and reducing the loads on the drum and the sheave bearings.

The air caliper brakes are operated with an air operating system. The air caliper break reduces most of the force needed to operate a manual brake handle because the air operated a feather light touch is all that is need to operate the air caliper brakes. Valves only require minimum effort to operate the air caliper brakes. The air caliper brakes eliminate the need to adjust the brake bands or any linkages.

Figure 9:
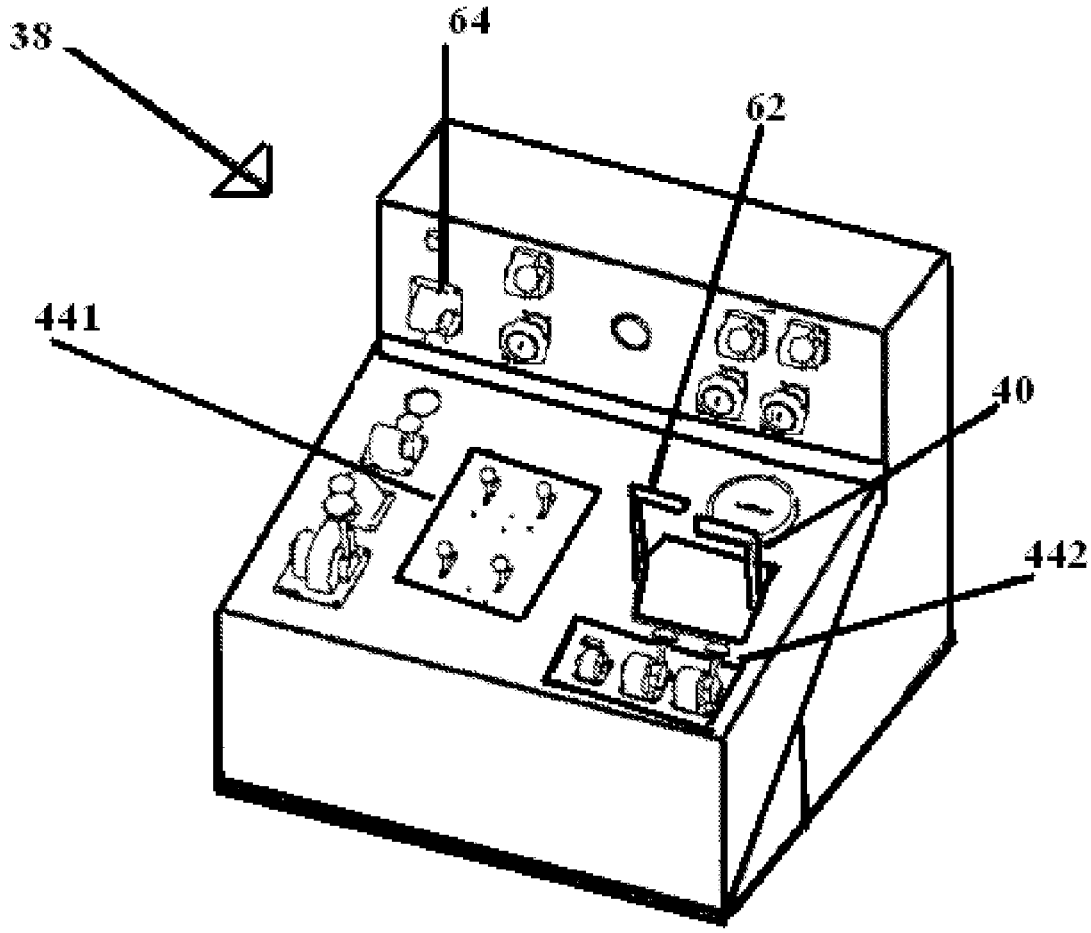
FIG. 9 depicts an embodiment of the control panel usable with the transport rig.

FIG. 9 depicts an embodiment of a control panel 38 for operating the top drive motor, the hydraulic system, the air caliper brakes, the top drive, pumps, generator, and braking system. The control panel 38 includes a forward and reverse throttle 64 for the top drive, and a power throttle 40 for the top drive and the drive engine 20. The embodiment of the control panel 38 is also depicted having an emergency all stop 64 for cutting power to the top drive, hydraulic system, and drive motor. The emergency all stop 64 can be a breaker switch, a button, a switch, or a fuse.

Four up down hydraulic levers 441 are used to control the hydraulic wrench 46. Hydraulic levers 442 control the hydraulic pipe handler. It is contemplated that the control panel 38 can be arranged differently, or equipped with additional or different levers.

While these embodiments have been described with emphasis on the preferred embodiments, it should be understood that within the scope of the appended claims, the embodiments might be practiced other than as specifically described herein.

What is claimed is:

1. A transport rig comprising:

at least one duel axel, with a single point suspension;

at least two pneumatic independently and vertically adjustable load supporting axels;

a rig floor mounted elevated to the axels, wherein the rig floor comprises a drawworks assembly, a drive engine operatively connected to the drawworks assembly, a second engine for providing hydraulic power, and at least one air caliper brake secured to the rig floor for additionally controlling movement of the top drive along the rails of the derrick;

at least four hydraulic leveling jacks with control levers connected to the rig floor for raising and lowering the rig floor;

an elevated drilling floor integrally connected to the rig floor supporting a derrick comprising at least two rails for supporting a traveling top drive supported by a crown block connected to the derrick, a control panel comprising a power throttle for operating the top drive, a slip bowl for supporting drilling tubulars, and a hydraulic wrench for making up and breaking out the drilling tubulars generally in line with the slip bowl, wherein the elevated drilling floor has a height sufficient to permit the installation of well control equipment between the drilling floor and the ground;

a pipe-handler having at least two pipe grippers connected to the drilling floor for transporting the drilling tubulars from a horizontal storage position to the derrick for engagement with the traveling top drive; and a moveable mat for supporting the rig floor while drilling.

2. The transport rig of claim 1, wherein the control panel further comprises an emergency all stop for stopping the top drive, the hydraulic wrench, and hydraulic pipe handler.

3. The transport rig of claim 2, wherein the all stop control is a button, switch, or a fuse.

4. The transport rig of claim 1, wherein the control panel further comprises a forward and reverse throttle for the top drive.

5. The transport rig of claim 1, further comprising at least two additional leveling jacks which are mechanically operable.

6. The transport rig of claim 1, further comprising an auxiliary control panel allowing two people to simultaneously control the hydraulic system.

7. The transport rig of claim 1, wherein the moveable mat is a two piece mat.

8. The transport rig of claim 1, wherein the air caliper brake is air cooled.

9. The transport rig of claim 1, further comprising a subdeck disposed beneath the rig floor, wherein the subdeck comprises an array of trays to accommodate hydraulic lines and to catch rig fluid.

* * * * *